US010849433B2

(12) United States Patent
Gajjar et al.

(10) Patent No.: US 10,849,433 B2
(45) Date of Patent: Dec. 1, 2020

(54) ADJUSTABLE BED WITH TRI-FOLD ADJUSTABLE FOUNDATION

(71) Applicant: ASCION, LLC, Bloomfield Hills, MI (US)

(72) Inventors: Kushan Gajjar, Bloomfield Hills, MI (US); Martin B. Rawls-Meehan, Birmingham, MI (US)

(73) Assignee: ASCION, LLC, Bloomfield Hills, MI (US)

( * ) Notice: Subject to any disclaimer, the term of this patent is extended or adjusted under 35 U.S.C. 154(b) by 241 days.

(21) Appl. No.: 16/117,846

(22) Filed: Aug. 30, 2018

(65) Prior Publication Data

US 2019/0069683 A1 Mar. 7, 2019

Related U.S. Application Data

(60) Provisional application No. 62/553,339, filed on Sep. 1, 2017.

(51) Int. Cl.

| | |
|---|---|
| ***A47C 19/02*** | (2006.01) |
| ***A47C 19/04*** | (2006.01) |
| ***A47C 20/04*** | (2006.01) |
| ***A47C 19/12*** | (2006.01) |
| ***A47C 17/86*** | (2006.01) |
| ***A61G 7/018*** | (2006.01) |
| ***A61G 7/015*** | (2006.01) |
| ***A47C 20/08*** | (2006.01) |

(52) U.S. Cl.

CPC ..... *A47C 19/021* (2013.01); *A47C 19/045* (2013.01); *A47C 19/122* (2013.01); *A47C 20/041* (2013.01); *A47C 17/86* (2013.01); *A47C 20/08* (2013.01); *A61G 7/015* (2013.01); *A61G 7/018* (2013.01); *A61G 2203/12* (2013.01)

(58) Field of Classification Search

CPC ... A47C 19/021; A47C 19/122; A47C 19/045; A47C 20/041; A47C 17/86; A47C 20/08; A61G 2203/12; A61G 7/018; A61G 7/015

See application file for complete search history.

(56) References Cited

U.S. PATENT DOCUMENTS 926,438 A * 6/1909 Ranko ..... A47C 19/122 5/111
1,218,868 A * 3/1917 Jones ..... A47C 19/122 5/111

(Continued)

*Primary Examiner* — Myles A Throop
(74) *Attorney, Agent, or Firm* — Marshall, Gerstein & Borun LLP

(57) ABSTRACT

The disclosure generally relates to an adjustable foundation or bed, in particular having a tri-fold adjustable foundation. Three segments of the adjustable foundation, including a mattress support surface with three deck support sections and a subframe with three longitudinal support sections, are foldable/rotatable around two opposing pivot axes such that the three segments can be positioned in a folded, overlapping configuration that is convenient for shipping/transportation, having substantially smaller maximum dimensions than the adjustable foundation in a flat, non-folded configuration. The folded adjustable foundation can be conveniently unfolded and locked into a flat, non-folded configuration suitable for use to support a mattress and a person sleeping/resting thereon.

9 Claims, 6 Drawing Sheets

(56) References Cited

U.S. PATENT DOCUMENTS

| | | | | | |
|---|---|---|---|---|---|
| 1,392,954 | A * | 10/1921 | Magariello | A47C 19/122 | 5/202 |
| 1,945,186 | A * | 1/1934 | Frank | A47C 17/23 | 5/36 |
| 2,064,839 | A * | 12/1936 | Kroll | A47C 19/122 | 16/324 |
| 2,631,303 | A * | 3/1953 | Valentine | A47C 1/146 | 5/111 |
| 2,664,145 | A * | 12/1953 | Creveling | A47C 17/23 | 5/36 |
| 2,988,757 | A * | 6/1961 | Hubbell | A47C 13/00 | 5/36 |
| 3,121,237 | A * | 2/1964 | Brindisi | A47C 17/225 | 5/36 |
| 8,997,273 | B2 * | 4/2015 | Murphy | A47C 17/225 | 5/13 |
| 9,420,889 | B2 * | 8/2016 | Murphy | A47C 13/00 | |
| 10,213,027 | B2 * | 2/2019 | Lo | A47C 17/82 | |
| 2013/0038094 | A1 * | 2/2013 | Chen | A47C 19/122 | 297/42 |
| 2017/0347807 | A1 * | 12/2017 | Totemeier | A47C 19/005 | |
| 2017/0360209 | A1 * | 12/2017 | Zhou | A61G 7/1074 | |
| 2018/0110340 | A1 * | 4/2018 | Rawls-Meehan | A47C 19/025 | |
| 2018/0125249 | A1 * | 5/2018 | Chung | A47C 19/021 | |
| 2019/0069687 | A1 * | 3/2019 | Liang | A47C 20/041 | |
| 2019/0223609 | A1 * | 7/2019 | Sherman | A47C 27/14 | |
| 2019/0239653 | A1 * | 8/2019 | Shan | A47C 17/86 | |
| 2019/0328593 | A1 * | 10/2019 | Choi | A61G 7/015 | |
| 2020/0187662 | A1 * | 6/2020 | Zeng | A47C 20/041 | |

* cited by examiner

ADJUSTABLE BED WITH TRI-FOLD ADJUSTABLE FOUNDATION

CROSS REFERENCE TO RELATED APPLICATION

Priority is claimed to U.S. Provisional Application No. 62/553,339 (filed Sep. 1, 2017), which is incorporated herein by reference in its entirety.

STATEMENT OF GOVERNMENT INTEREST

None.

BACKGROUND OF THE DISCLOSURE

Field of the Disclosure

The disclosure generally relates to an adjustable foundation or bed, in particular having a tri-fold adjustable foundation. Three segments of the adjustable foundation are foldable/rotatable around two opposing pivot axes such that the three segments can be positioned in a folded, overlapping configuration that is convenient for shipping or transportation. The folded adjustable foundation can be conveniently unfolded and locked into a flat, non-folded configuration suitable for use to support a mattress and a person sleeping/resting thereon.

SUMMARY

In one aspect, the disclosure relates to an adjustable foundation 20 (e.g., for an adjustable bed 10 with a mattress 300 thereon) comprising: (a) a mattress support surface 100 having a top surface 112 and an opposing bottom surface, the mattress support surface 100 comprising (i) a first deck support section 110D, (ii) a second deck support section 110C pivotally attached to the first deck support section 110D at a first lateral pivot axis $P_1$ positioned below the bottom surface, and (iii) a third deck support section 110B pivotally attached to the second support section 110C at a second lateral pivot axis $P_2$ positioned above the top surface 112; and (b) a subframe 230 positioned below the bottom surface of the mattress support surface 110, the subframe 230 comprising (i) a first longitudinal support section 236D below the first deck support section 110D, (ii) a second longitudinal support section 236C below the second deck support section 110C, and (iii) a third longitudinal support section 236B below the third deck support section 110B. The first lateral pivot axis $P_1$ and the second lateral pivot axis $P_2$ are positioned at opposing lateral sides of the second deck support section 110C. The second deck support section 110C is fixedly mounted to the second longitudinal support section 236B (e.g., via an intervening second frame support section 210B). The first, second, and third longitudinal support sections 236D/C/B are separate, but adapted to be locked together in a flat configuration (e.g., substantially straight in the longitudinal direction) by connectors 237 (or connection means) at opposing longitudinal ends of the second longitudinal support section 236C. When the first, second, and third longitudinal support sections 236D/C/B are not locked together in a flat configuration (e.g., due to removal or absence of the connectors 237 or connection means), the adjustable foundation 20 is adapted to fold into a tri-fold configuration 20F in which (i) the first deck support section 110D and the first longitudinal support section 236D are rotated around the first lateral pivot axis $P_1$ (e.g., 180° from flat) and positioned below the second longitudinal support section 236C, and (ii) the third deck support section 110B and the third longitudinal support section 236B are rotated around the second lateral pivot axis $P_2$ (e.g., 180° from flat) and positioned above the second deck support section 110C.

Various refinements of the adjustable bed and foundation are possible.

In a refinement, the first lateral pivot axis $P_1$ is positioned at or below a bottom edge of the subframe 230 (e.g., at or below a bottom edge of the first longitudinal support section 236D and/or the second longitudinal support section 236C).

In another refinement, the adjustable foundation 20 further comprises a first hinge 212 defining the first lateral pivot axis $P_1$, the first hinge 212 being mounted to the first deck support section 110D and being (pivotally) mounted to the second deck support section 110C; and a second hinge 214 defining the second lateral pivot axis $P_2$, the second hinge 214 being mounted to the second deck support 110C section and being mounted to the third deck support section 110B.

In another refinement, the adjustable foundation 20 further comprises the connectors 237 locking the first, second, and third longitudinal support sections 236D/C/B together in a flat configuration.

In another refinement, the adjustable foundation 20 further comprises a first actuator 240A having a first end mounted to the first deck support section 110D and a second opposing end mounted to the subframe 230 (e.g., to the first longitudinal support section 236D); and a second actuator 240B having a first end mounted to the third deck support section 110B and a second opposing end mounted to the subframe 230 (e.g., to the third longitudinal support section 236B).

In another refinement, the first deck support section 110D corresponds to a back and head portion of the mattress support surface, the second deck support section 110C corresponds to a bottom portion of the mattress support surface, and the third deck support section 110B corresponds to a leg portion of the mattress support surface.

In another refinement, first deck support section 110D corresponds to a leg portion of the mattress support surface, the second deck support section 110C corresponds to a bottom portion of the mattress support surface, and the third deck support section 110B corresponds to a back and head portion of the mattress support surface.

In another refinement, the mattress support surface 110 further comprises a fourth deck support section 110A pivotally attached to the third deck support section 110B.

In another refinement, the adjustable foundation 20 further comprises a mattress 300 positioned above the mattress support surface 100.

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

While the disclosed apparatus and methods and are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

DETAILED DESCRIPTION

The disclosure generally relates to an adjustable foundation or bed, in particular having a tri-fold adjustable foundation. Three segments of the adjustable foundation, including a mattress support surface with three deck support sections and a subframe with three longitudinal support sections, are foldable/rotatable around two opposing pivot axes such that the three segments can be positioned in a folded, overlapping configuration that is convenient for shipping/transportation, having substantially smaller maximum dimensions than the adjustable foundation in a flat, non-folded configuration. The folded adjustable foundation can be conveniently unfolded and locked into a flat, non-folded configuration suitable for use to support a mattress and a person sleeping/resting thereon.

Figure 1:
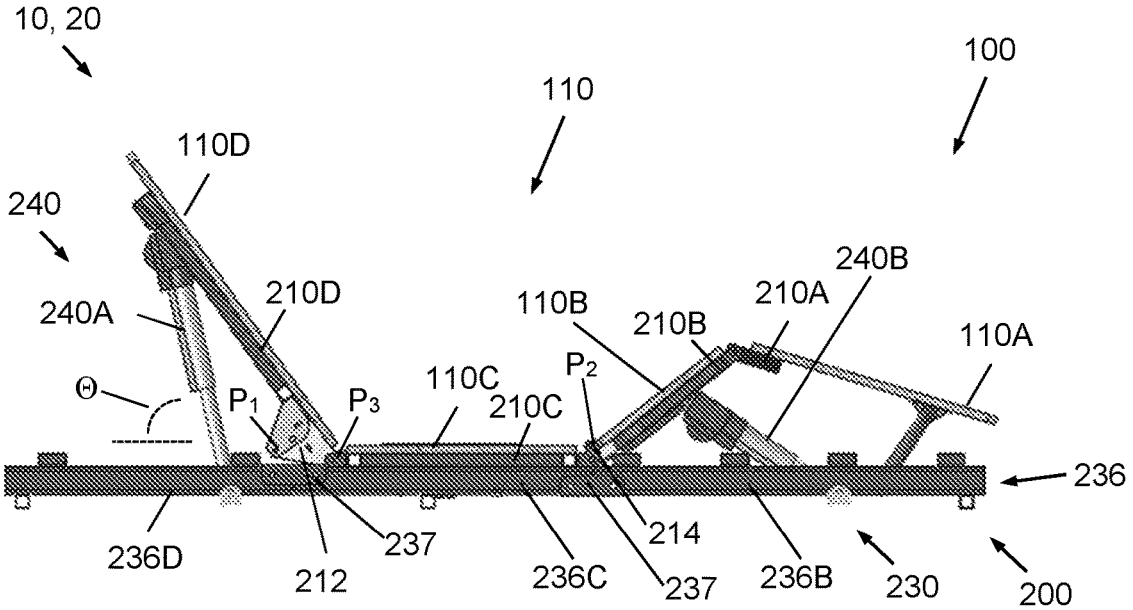
FIG. 1 is a side view of a tri-fold adjustable foundation in an articulated mattress support position and a flat subframe position according to the disclosure.
Figure 2:
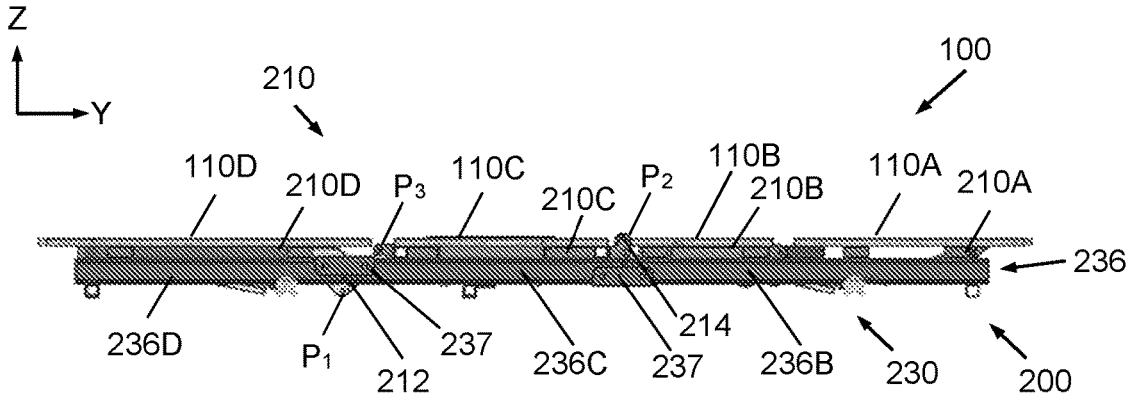
FIG. 2 is a side view of a tri-fold adjustable foundation in a substantially flat mattress support position and a flat subframe position according to the disclosure.
Figure 3:
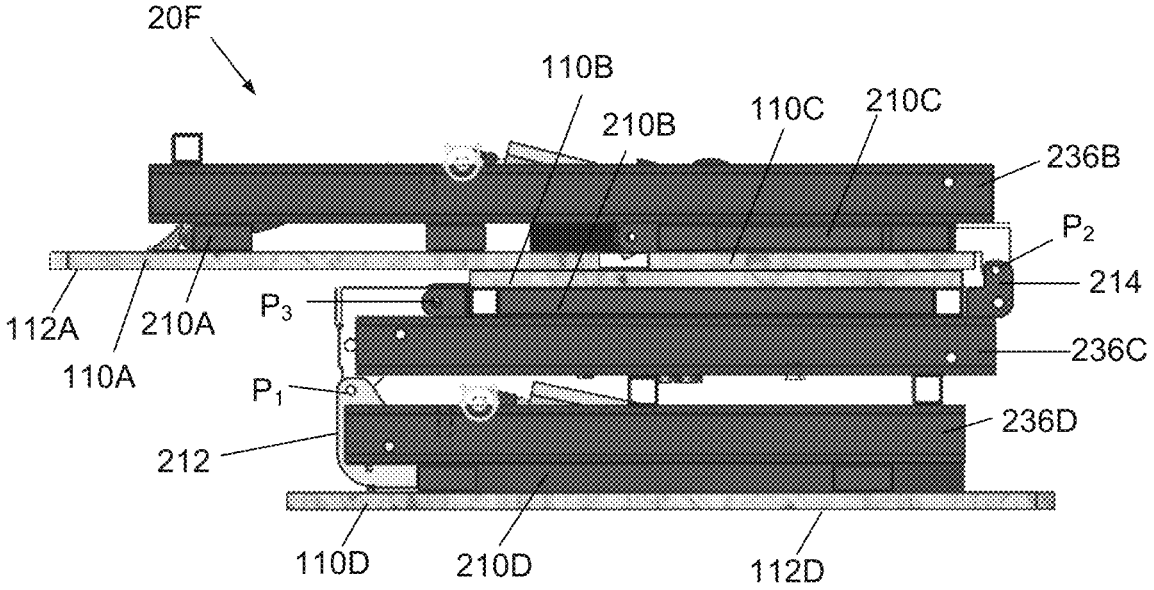
FIG. 3 is a side view of a tri-fold adjustable foundation in a folded configuration according to the disclosure.
Figure 4:
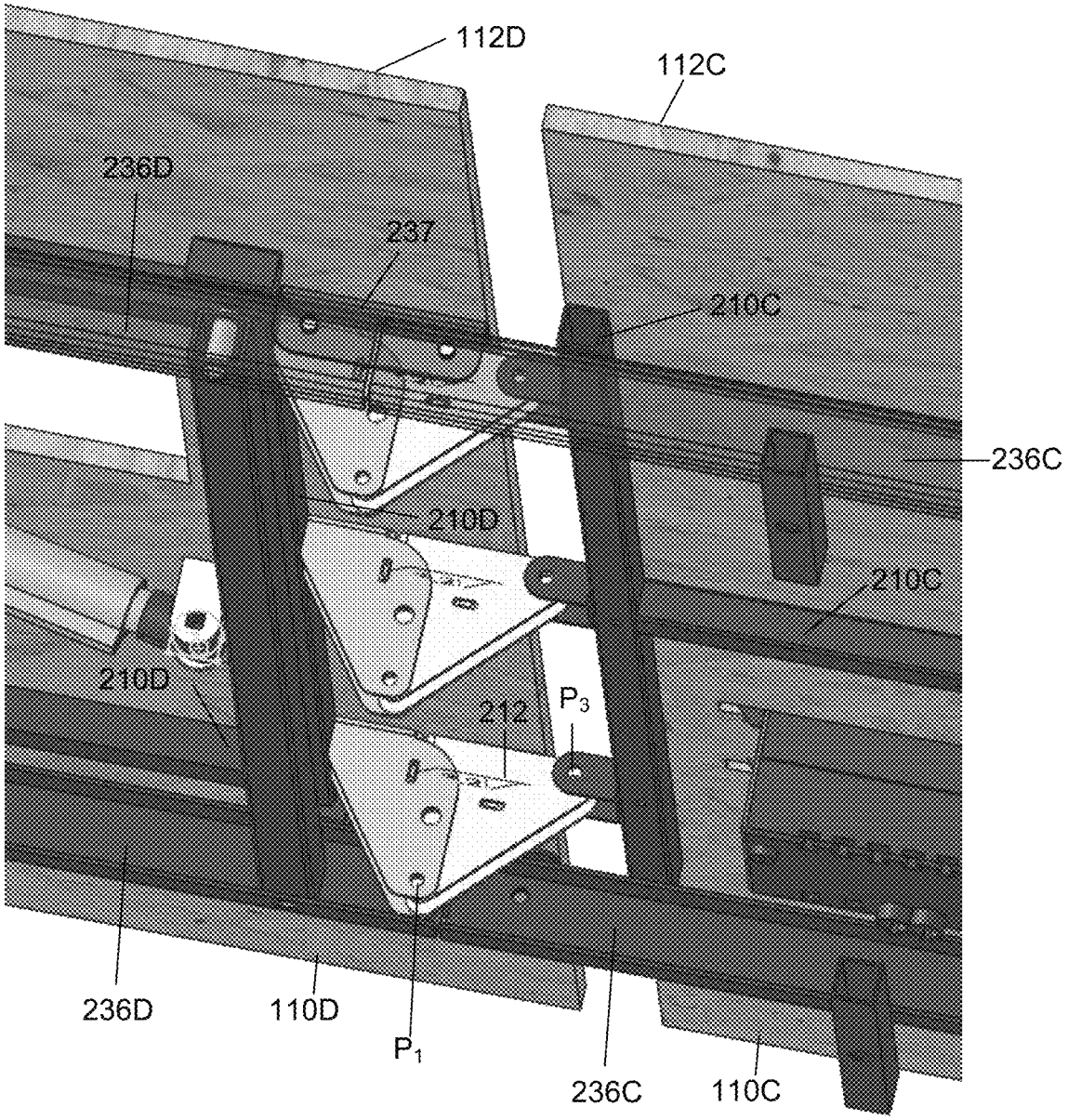
FIG. 4 is a bottom perspective view of a tri-fold adjustable foundation at the head and bottom sections in a substantially flat mattress support position and a flat subframe position according to the disclosure.
Figure 5:
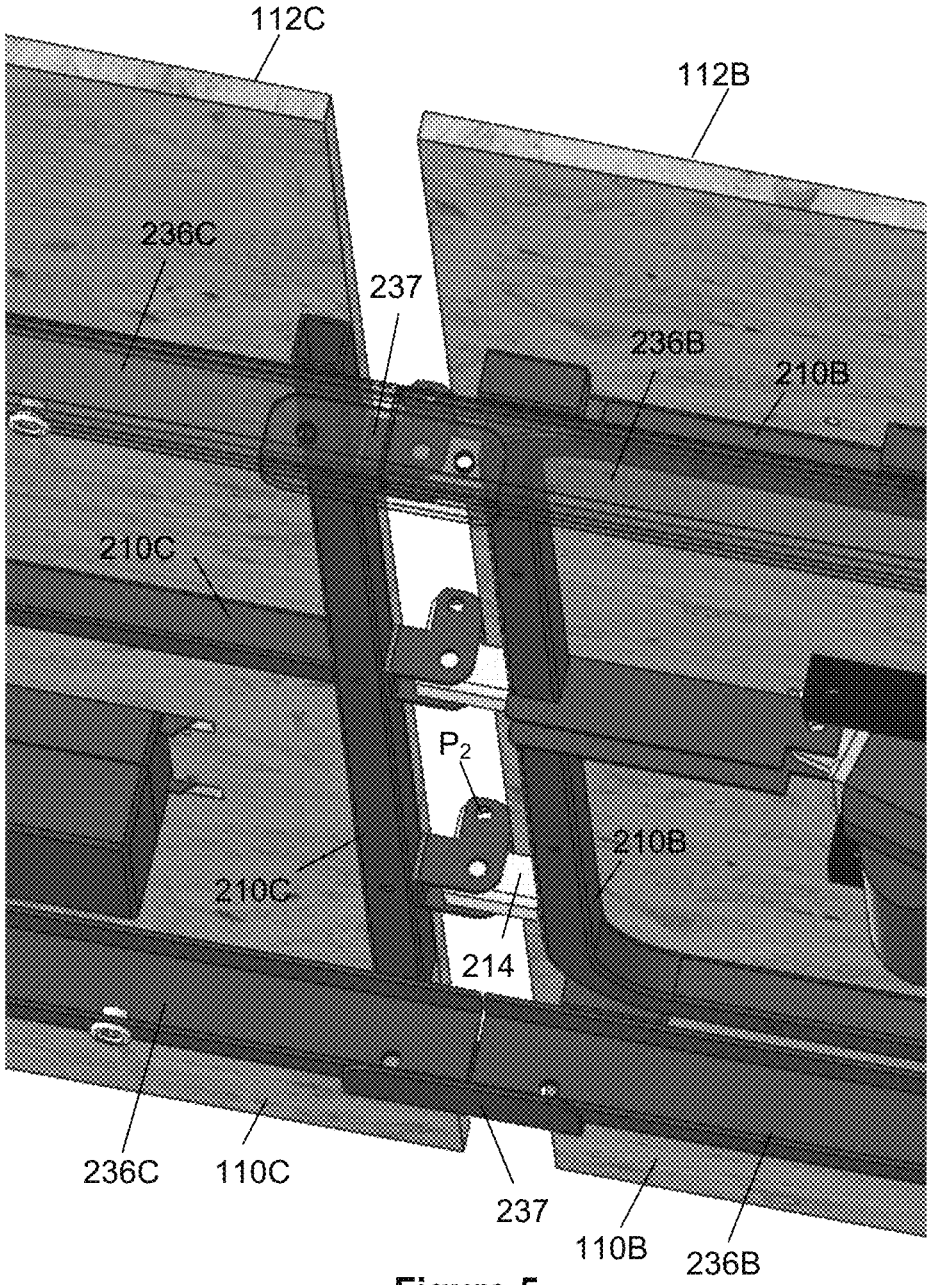
FIG. 5 is a bottom perspective view of a tri-fold adjustable foundation at the bottom and leg sections in a substantially flat mattress support position and a flat subframe position according to the disclosure.
Figure 6:
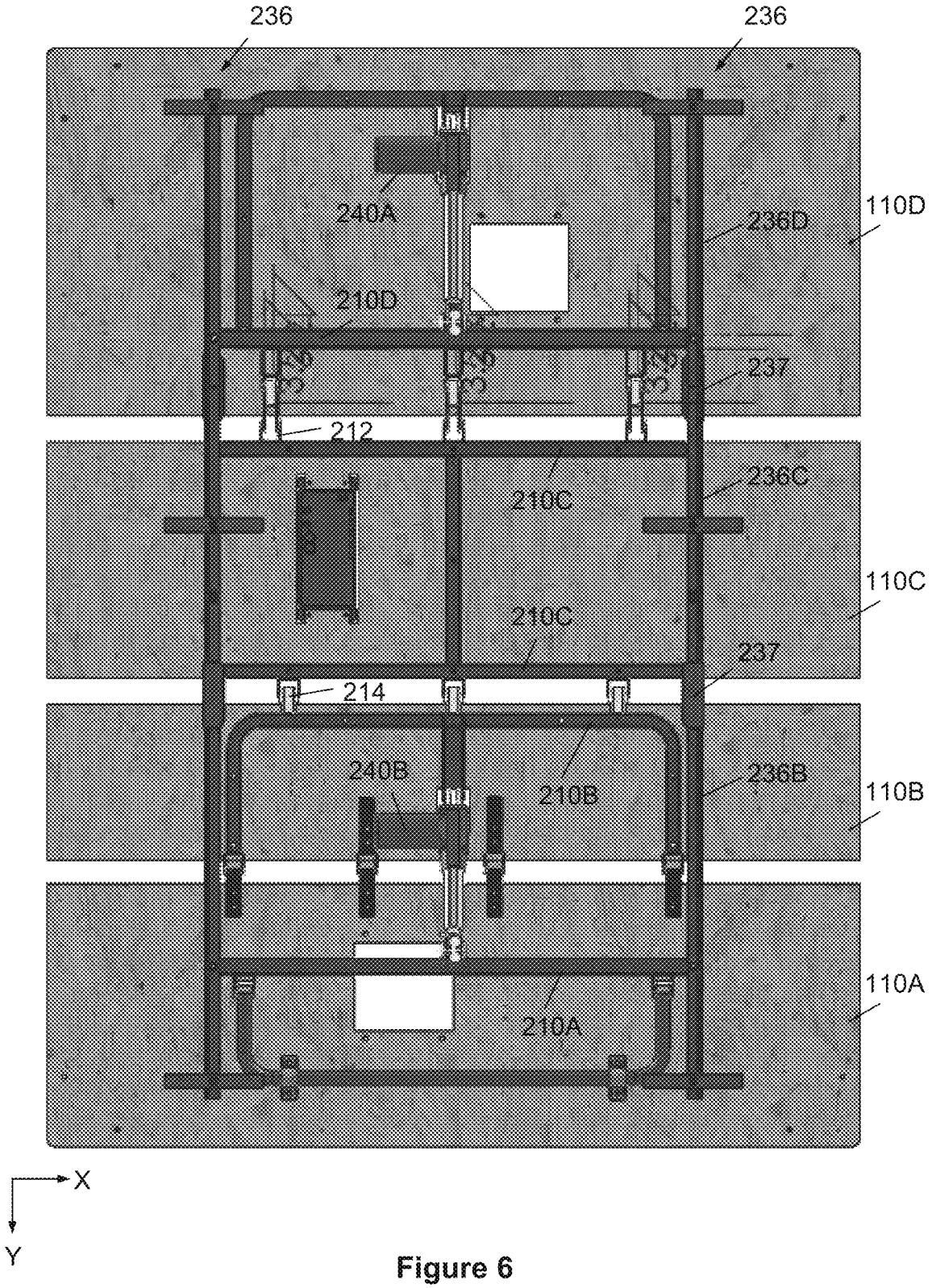
FIG. 6 is a bottom plan view of a tri-fold adjustable foundation in a substantially flat mattress support position and a flat subframe position according to the disclosure.
Figure 7:
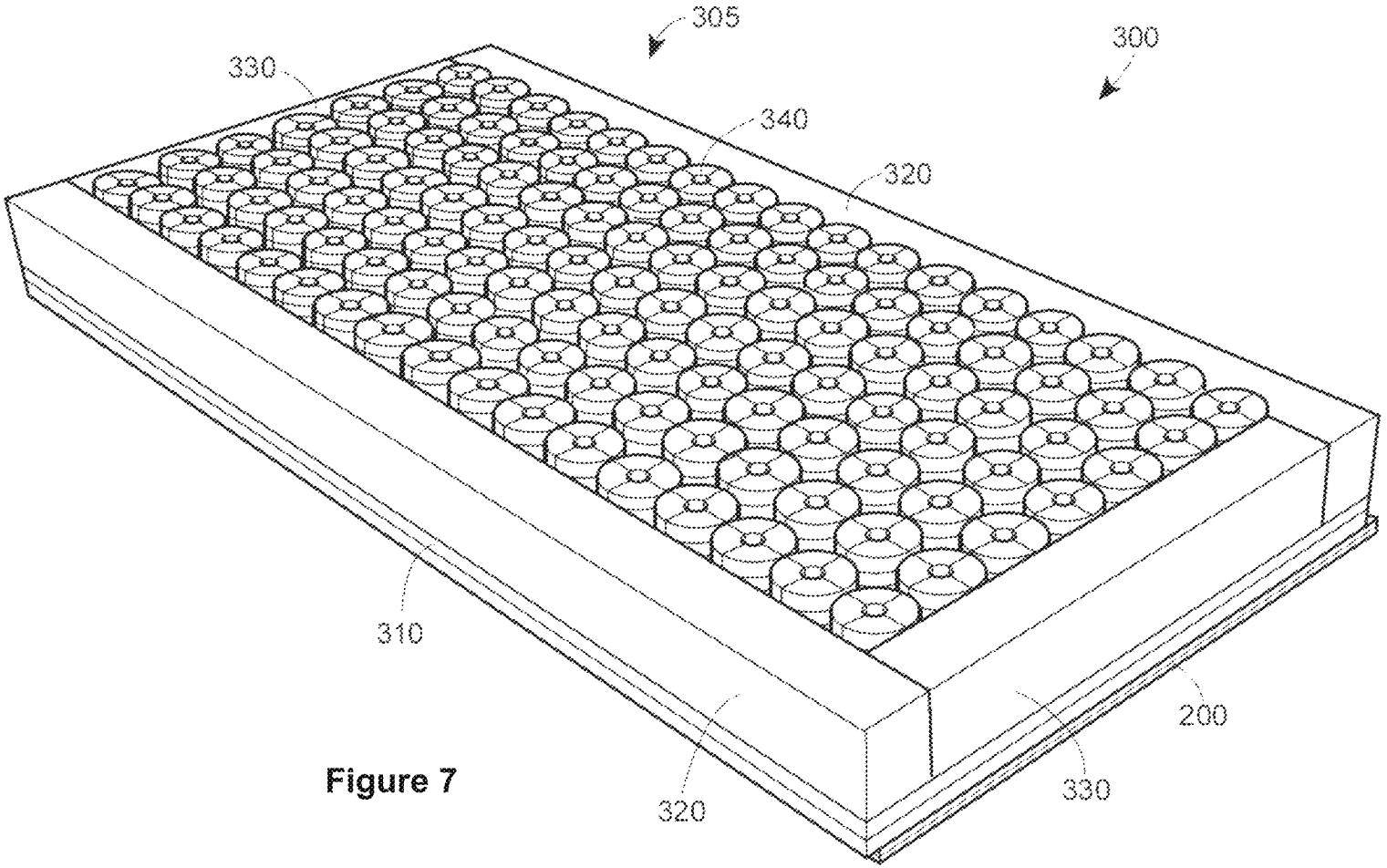
FIG. 7 is a top perspective illustration of a mattress according to the disclosure.

FIGS. 1-7 generally illustrate a tri-fold adjustable bed 10 or adjustable foundation 20 according to the disclosure. FIG. 1 is a side view of a tri-fold adjustable foundation 20 in an articulated mattress support 100 position and a flat subframe 230 position according to the disclosure. The illustrated adjustable foundation 20 can include a mattress support (or deck) 100 mounted to an adjustable frame 200. The adjustable bed 10 further includes a mattress 300 (e.g., as illustrated in FIG. 7 or otherwise, but not shown in FIG. 1) sitting atop the adjustable foundation 20. FIG. 2 is a side view of a tri-fold adjustable foundation 20 in a substantially flat mattress support position and a flat subframe position according to the disclosure. FIG. 3 is a side view of a tri-fold adjustable foundation 20 in a folded configuration according to the disclosure. FIG. 4 is a bottom perspective view of a tri-fold adjustable foundation 20 at the head and bottom sections in a substantially flat mattress support position and a flat subframe position according to the disclosure. FIG. 5 is a bottom perspective view of a tri-fold adjustable foundation 20 at the bottom and leg sections in a substantially flat mattress support position and a flat subframe position according to the disclosure. FIG. 6 is a bottom plan view of a tri-fold adjustable foundation 20 in a substantially flat mattress support position and a flat subframe position according to the disclosure. FIG. 7 is a top perspective illustration of a mattress 300 according to the disclosure.

The mattress support 100 includes a deck support 110 platform, for example including a plurality of deck support sections 110A-110D as illustrated. A deck support platform 110 formed from a plurality of deck support sections 110A-110D, each having a corresponding upper surface 112A-112D (i.e., the surface which supports the mattress 300) is suitable for the adjustable foundation 20. In the illustrated embodiment, section 110A corresponds to the foot portion of the bed, section 110B corresponds to the leg portion of the bed, section 110C corresponds to the bottom portion of the bed, and section 110D corresponds to the head and neck portion of the bed 10/foundation 20 (i.e., where the sections correspond to the body portion of a user laying on the bed 10/mattress 300 in a normal use orientation). Each section 110A-110D includes longitudinally opposed ends 110$A_1$ and 110$A_2$, 110$B_1$ and 110$B_2$, 110$C_1$ and 110$C_2$, 110$D_1$ and 110$D_2$, respectively, where the longitudinal direction Y is generally defined as being perpendicular to the pivot axis P (described below) and/or along the mattress support 100 length or mattress 300 length. Each deck support section 110A-110D can be pivotally attached to one or more adjacent sections (e.g., directly or indirectly via underlying frame 200 structure as described below), thus allowing each section 110A-110D to rotate independently around the lateral pivot axis P (e.g., an axis generally in the lateral direction X and perpendicular to the longitudinal direction Y). The mattress support 100 generally includes at least two deck support sections, for example including a first (foot) support section 110A, a second (leg) support section 110B pivotally attached to the first section 110A, a third (bottom) support section 110C pivotally attached to the second section 110B, and a fourth (head/neck) support section 110D pivotally attached to the third section 110C as shown in FIG. 1. In other embodiments (not shown), the mattress support 100 can have fewer or more support sections (e.g., a first (foot) support section, a second (leg and bottom) support section pivotally attached thereto, and a third (head/neck) support section pivotally attached thereto). In some embodiments the support sections 110A-110D can be formed from a rigid support material such as wood or metal. In other embodiments the support sections 110A-110D can be formed from a flexible fabric or padding material (e.g., alone or in combination with a rigid support material, such as a cover or padding for an underlying rigid support material).

The adjustable frame 200 generally provides the mechanical, electrical, and electronic support and articulation components for the adjustable foundation 20 and bed 10. As illustrated, the adjustable frame 200 includes a frame support 210, for example including a plurality of frame support sections 210A-210D as illustrated and corresponding to the deck support sections 110A-110D. Each deck support section 110A-110D can be fixedly or removably mounted (e.g., via bolts, screws, or other fastener or adhesive components) to its underlying frame support section 210A-210D such that when one or more frame support sections 210A-210D are articulated, the deck support sections 110A-110D are correspondingly articulated. As illustrated, each frame support section 210A-210D can be pivotally attached at a pivot axis P to one or more adjacent sections (e.g., directly as illustrated and providing an indirect pivotal attachment for corresponding deck support sections), thus allowing each section 210A-210D to rotate independently around the lateral pivot axis P. The adjustable frame 200 generally includes at least two frame support sections, for example including a first (foot) support section 210A, a second (leg) support section 210B pivotally attached to the first section 210A, a third (bottom) support section 210C pivotally attached to the second section 210B, and a fourth (head/neck) support section 210D pivotally attached to the third section 210C as shown in FIG. 1. In other embodiments (not shown), the adjustable frame 200 can have fewer or more frame support sections (e.g., a first (foot) support section, a second (leg and bottom) support section pivotally attached thereto, and a third (head/neck) support section pivotally attached thereto).

As illustrated, the adjustable frame 200 further includes a subframe bed frame 230. When in a locked/extended configuration, the subframe 230 can be a rigid, non-articulatable stationary frame structure which sits on a floor or within a decorative bed frame common in the furniture industry such as a platform bed (e.g., via various leg elements, not shown) and provides stability for the bed foundation 20 as the adjustable frame 200 is articulated to various different positions. The adjustable frame 200 can further include one or more support members 220 connecting structure between the subframe 230 and the frame support 210 and sections 210A-210D thereof. In some embodiments, one or more of the frame sections 210A-210D can be fixed in position relative to the subframe 230 (e.g., bottom section 210C as illustrated) and be unable to rotate or articulate relative to the subframe 230, although other frame sections pivotally attached thereto are able to rotate or articulate. As further illustrated, the adjustable frame 200 can include one or more actuators 240 (e.g., a first actuator 240A and a second actuator 240B as shown) variously mounted to one or more of the subframe 230, a support member 220, a frame support section 210A-210D, and a deck support section 110A-110D (e.g., directly mounted thereto or indirectly via the corresponding frame support section 210A-210D). In some embodiments, the subframe 230, the support members 220, and the frame support sections 210A-210D can be formed from metal such as steel. The actuators 240 can be any of those commonly known in the art, such as linear actuators. The actuators 240 and, correspondingly, the configuration or position of the adjustable frame 200, mattress support 100, and mattress 300 can be controlled and adjusted by a suitable power supply 250, an adjustable bed controller 260 (illustrated as a combined unit with the power supply 250; e.g., programmable logic controller or otherwise), and a remote control to deliver repositioning commands (not shown).

The folded, overlapping configuration of the adjustable foundation 20F illustrated in FIG. 3 is particularly convenient for shipping or transportation. The folded configuration of the adjustable foundation 20F is relatively light weight and has small enough dimensions to meet packaging requirements for many commercial shippers. This is in contrast to the adjustable foundation 20 in its normal, extended configuration which is suitable for use as a bed foundation, but which has an excess length making it unsuitable for commercial shipment and requiring custom delivery. Suitably, the folded configuration of the adjustable foundation 20F fits within a right rectangular prism (e.g., the shape of a generally rectangular shipping box) with edge lengths A≥B≥C, subject to the one or more of the following dimensional constraints. Preferably, the edge length A is up to 90, 95, 100, 105, 108, 110, 115, or 119 inches (229, 241, 254, 267, 274, 279, or 302 cm) and/or at least 40, 60, 80, or 100 inches (102, 152, 203, or 254 cm). Preferably, the package parameter A+2B+2C is up to 100, 115, 130, 145, 155, or 165 inches (254, 292, 330, 368, 394, 419) and/or at least 60, 80, 100, 120, or 140 inches (152, 203, 254, 305, or 356 cm). In various embodiments, the weight of the adjustable foundation 20F is up to 100, 125 or 150 lb (45, 57, or 68 kg) and/or at least 50, 70, or 100 lb (23, 32, or 45 kg). The foregoing weights generally include the mattress support surface components and the subframe components, and they can include or exclude electromechanical components (e.g., power supply, control box, and/or actuators, etc.) which can be pre-installed on the adjustable foundation 20F or shipped in separate package if desired for convenience or total weight considerations.

The mattress 300 is not particularly limited, and it can be a conventional mattress 300 (e.g., a spring or coil mattress, memory foam mattress, air mattress) with a base 310 (e.g., a continuous fabric material) suitable for use on a mattress support structure such as a fixed bed frame or an adjustable bed frame. In the illustrated embodiment in FIG. 7, the mattress 300 includes a mattress containment frame 305 including a plurality of foam cells (or foam springs) 340 positioned in the frame 305 to provide the sleeping support surface for the mattress. The mattress containment frame 305 includes a lower/bottom base 310, sidewalls 320, and endwalls 330 which generally define the interior frame 305 volume housing the foam cells 340. The sidewalls 320 and endwalls 330 suitably are formed from a foam material. The base 310 can be a generally continuous fabric material (e.g., a non-woven fabric material). The mattress 300 is generally positioned above the mattress support 100 surface 112, for example sitting directly atop the deck support sections 110A-110D. In other embodiments, other structure between the mattress 300 and mattress support 100 surface 112 can be present, for example a padding or cushion material (e.g., which can be continuous or include openings).

Rawls-Meehan U.S. Pat. Nos. 7,321,811, 7,465,280, 7,805,785, 7,930,783, 7,933,669, 7,979,169, 8,019,486, 8,032,263, 8,032,960, 8,046,114, 8,046,115, 8,046,116, 8,046,117, 8,050,805, 8,069,512, 8,078,336, 8,078,337, 8,150,562, 8,375,488, 8,565,934, and 8,682,457 as well as Rawls-Meehan U.S. Publication No. 2012/0057685 are incorporated herein by reference in their entireties and variously disclose mattresses including foam springs or foam cells and materials/configurations therefor, adjustable bed assemblies including adjustable mattress frames, electrical, mechanical, and electronic components associated therewith, and remote controls for use therewith, all of which may be used individually or collectively in combination with the adjustable bed described herein.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the compositions, processes, or apparatus are described as including components, steps, or materials, it is contemplated that the compositions, processes, or apparatus can also comprise, consist essentially of, or consist of, any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

PARTS LIST

10 adjustable bed (including mattress support 100, adjustable frame 200, and mattress 300)
20 adjustable foundation (including mattress support 100 and adjustable frame 200)
20F adjustable foundation in folded configuration
100 mattress support (or deck) surface
110 deck support (sections 110A-D as foot, leg, bottom, and back/head portions; longitudinally opposed ends 110$A_1$ and 110$A_2$, 110$B_1$ and 110$B_2$, 110$C_1$ and 110$C_2$, 110$D_1$ and 110$D_2$)
112 top surface of deck support (sections 112A-D as for deck support)
200 adjustable (bed) frame
210 frame support (sections 210A-D as for deck support)
212 hinge with pivot axis $P_1$ below bottom surface of deck support
214 hinge with pivot axis $P_2$ above top surface of deck support
220 support member
230 subframe or stationary bed frame
232 lower longitudinal support
234 lower lateral support
236 upper longitudinal support (sections 236A-D as for deck support)
237 connector/bracket
238 upper lateral support
240 actuator or movement/articulation means
242 first/proximal end of actuator (e.g., winding)
244 second/distal end of actuator (e.g., distal end of push rod)
250 power supply
260 adjustable bed controller
300 mattress (300A: foot end; 300D: head end)
305 containment frame
310 base
320 sidewalls
330 endwalls
340 foam cells or foam springs
D vertical distance
P pivot axis
$P_1$ first lateral pivot axis between back and bottom sections below bottom surface
$P_2$ second lateral pivot axis between bottom and leg sections above top surface
$P_3$ third lateral pivot axis between back and bottom sections
X lateral direction
Y longitudinal direction
Z vertical/normal direction
Θ angle of articulation between adjacent sections

What is claimed is:

1. An adjustable foundation comprising:

(a) a mattress support surface having a top surface and an opposing bottom surface, the mattress support surface comprising (i) a first deck support section, (ii) a second deck support section pivotally attached to the first deck support section at a first lateral pivot axis positioned below the bottom surface, and (iii) a third deck support section pivotally attached to the second support section at a second lateral pivot axis positioned above the top surface; and (b) a subframe positioned below the bottom surface of the mattress support surface, the subframe comprising (i) a first longitudinal support section below the first deck support section, (ii) a second longitudinal support section below the second deck support section, and (iii) a third longitudinal support section below the third deck support section;

wherein:

the first lateral pivot axis and the second lateral pivot axis are positioned at opposing lateral sides of the second deck support section;

the second deck support section is fixedly mounted to the second longitudinal support section;

the first, second, and third longitudinal support sections are separate, but adapted to be locked together in a flat configuration by connectors at opposing longitudinal ends of the second longitudinal support section; and when the first, second, and third longitudinal support sections are not locked together in a flat configuration, the adjustable foundation is adapted to fold into a tri-fold configuration in which (i) the first deck support section and the first longitudinal support section are rotated around the first lateral pivot axis and positioned below the second longitudinal support section, and (ii) the third deck support section and the third longitudinal support section are rotated around the second lateral pivot axis and positioned above the second deck support section.

2. The adjustable foundation of claim 1, wherein the first lateral pivot axis is positioned at or below a bottom edge of the subframe.

3. The adjustable foundation of claim 1, further comprising:

a first hinge defining the first lateral pivot axis, the first hinge being mounted to the first deck support section and being mounted to the second deck support section; and a second hinge defining the second lateral pivot axis, the second hinge being mounted to the second deck support section and being mounted to the third deck support section.

4. The adjustable foundation of claim 1, further comprising the connectors locking the first, second, and third longitudinal support sections together in a flat configuration.

5. The adjustable foundation of claim 1, further comprising:

a first actuator having a first end mounted to the first deck support section and a second opposing end mounted to the subframe; and a second actuator having a first end mounted to the third deck support section and a second opposing end mounted to the subframe.

6. The adjustable foundation of claim 1, wherein the first deck support section corresponds to a back and head portion of the mattress support surface, the second deck support section corresponds to a bottom portion of the mattress support surface, and the third deck support section corresponds to a leg portion of the mattress support surface.

7. The adjustable foundation of claim 1, wherein the first deck support section corresponds to a leg portion of the mattress support surface, the second deck support section corresponds to a bottom portion of the mattress support surface, and the third deck support section corresponds to a back and head portion of the mattress support surface.

8. The adjustable foundation of claim 1, wherein the mattress support surface further comprises a fourth deck support section pivotally attached to the third deck support section.

9. The adjustable foundation of claim 1, further comprising: a mattress positioned above the mattress support surface.

* * * * *